US011090231B2

(12) United States Patent
Chen

(10) Patent No.: US 11,090,231 B2
(45) Date of Patent: Aug. 17, 2021

(54) COMPRESSIBLE DEVICE FOR DRINKING CONTAINER

(71) Applicant: Yu-Hsiang Chen, Tainan (TW)

(72) Inventor: Yu-Hsiang Chen, Tainan (TW)

( * ) Notice: Subject to any disclaimer, the term of this patent is extended or adjusted under 35 U.S.C. 154(b) by 0 days.

(21) Appl. No.: 16/563,127

(22) Filed: Sep. 6, 2019

(65) Prior Publication Data

US 2020/0253830 A1 Aug. 13, 2020

(30) Foreign Application Priority Data

Feb. 13, 2019 (TW) ..... 108104788

(51) Int. Cl.

| | |
|---|---|
| ***A61J 11/00*** | (2006.01) |
| ***B65D 47/06*** | (2006.01) |
| ***B65D 25/40*** | (2006.01) |
| ***A47G 19/22*** | (2006.01) |
| ***A61J 11/04*** | (2006.01) |
| *B65D 47/20* | (2006.01) |
| *A61J 9/00* | (2006.01) |

(52) U.S. Cl.

CPC ..... *A61J 11/0035* (2013.01); *A61J 11/04* (2013.01); *A61J 9/00* (2013.01); *B65D 47/2031* (2013.01); *B65D 2543/00046* (2013.01)

(58) Field of Classification Search

CPC ..... A47G 19/2272; A47G 19/2266; A47G 21/185; A61J 9/00; A61J 11/0035; A61J 11/04; A61J 11/002; A61J 11/001; A61J 11/0085; A61J 11/0065; A61J 11/0015; A61J 11/00; B65D 47/06; B65D 47/2031; B65D 2543/00046; B65D 2547/066; B65D 47/2018; B65D 2231/02

USPC ..... 215/387, 11.1, 11.4, 11.3, 11.5; 137/843; 220/714, 703

See application file for complete search history.

(56) References Cited

U.S. PATENT DOCUMENTS

| | | | | | |
|---|---|---|---|---|---|
| 420,651 | A * | 2/1890 | Fowler | A61J 11/002 | 215/11.4 |
| 1,081,464 | A * | 12/1913 | Pfeiffer | A61J 9/00 | 215/11.1 |
| 1,360,893 | A * | 11/1920 | Cowie | A61J 11/001 | 215/11.4 |
| 2,598,002 | A * | 5/1952 | Langdon | F16K 15/147 | 137/218 |
| 2,623,663 | A * | 12/1952 | Gassaway | B65D 35/40 | 222/490 |
| 2,802,608 | A * | 8/1957 | Gassaway | B65D 47/2031 | 222/490 |
| 3,104,787 | A * | 9/1963 | Thompson | B65D 83/48 | 222/490 |

(Continued)

*Primary Examiner* — Gideon R Weinerth
(74) *Attorney, Agent, or Firm* — Banner & Witcoff, Ltd.

(57) ABSTRACT

A compressible device for use on a drinking container includes a base and at least one spill-proof unit. The base includes a base wall defining a liquid flow passage, and a separation wall connected to the base wall and dividing the liquid flow passage into a liquid inlet zone and a liquid outlet zone. The at least one spill-proof unit includes a through slot formed in the separation wall and communicating with the liquid outlet zone, and a spill-proof seat including a plate body opposite to the through slot and formed with a first slit. When the plate body is compressed and deformed, the first slit is opened to communicate the liquid inlet zone with the liquid outlet zone through the through slot.

6 Claims, 14 Drawing Sheets

(56) References Cited

U.S. PATENT DOCUMENTS 3,517,682 A * 6/1970 Smith ..... F16K 15/202 137/68.23
4,690,375 A * 9/1987 Vorhis ..... F16K 7/02 222/490
4,828,141 A * 5/1989 Coy ..... B65D 17/502 220/380
4,836,404 A * 6/1989 Coy ..... B65D 17/502 220/714
4,946,062 A * 8/1990 Coy ..... B65D 17/502 215/11.4
4,993,568 A * 2/1991 Morifuji ..... A61J 11/002 215/11.1
5,035,340 A * 7/1991 Timmons ..... A61J 11/002 215/11.4
5,101,991 A * 4/1992 Morifuji ..... A61J 11/002 215/11.1
5,186,347 A * 2/1993 Freeman ..... A47G 19/2272 220/254.1
5,363,983 A * 11/1994 Proshan ..... B65D 47/06 220/380
5,366,109 A * 11/1994 Proshan ..... B65D 47/06 220/380
5,553,726 A * 9/1996 Park ..... A61J 11/0005 215/11.1
6,343,704 B1 * 2/2002 Prentiss ..... A61J 11/00 215/11.1
8,701,928 B2 * 4/2014 Samson ..... A47G 19/2272 220/703
D724,233 S * 3/2015 Moore ..... B65D 47/2031 D24/196
9,609,969 B1 * 4/2017 Panec ..... A45F 3/20
2002/0063103 A1 * 5/2002 Kiernan ..... A61J 11/001 215/11.4
2003/0141268 A1 * 7/2003 Kerns ..... A61J 17/10 215/11.1
2008/0237247 A1 * 10/2008 Mucci ..... B65D 3/06 220/713
2010/0127006 A1 * 5/2010 Krammes ..... A47G 19/2272 220/705
2013/0037510 A1 * 2/2013 Tamarit Rios ..... B65D 47/243 215/259
2014/0263157 A1 * 9/2014 Aller ..... B65D 47/2031 215/260
2015/0020906 A1 * 1/2015 Tollman ..... F16K 15/14 137/843
2015/0368006 A1 * 12/2015 Wiesman ..... A47G 19/2272 222/490
2016/0236834 A1 * 8/2016 Erlhofer ..... B65D 11/04
2016/0272381 A1 * 9/2016 Kim ..... A45D 34/00
2020/0253830 A1 * 8/2020 Chen ..... A61J 11/04

* cited by examiner

COMPRESSIBLE DEVICE FOR DRINKING CONTAINER

CROSS-REFERENCE TO RELATED APPLICATION

This application claims priority to Taiwanese Patent Application No. 108104788, filed on Feb. 13, 2019.

FIELD

The disclosure relates to a compressible device for use on a drinking container, such as a feeding bottle, a drinking cup or a water jug.

BACKGROUND

A water jug currently available in the market includes a container body for containing liquid, such as drinking water or beverage, a lid for openably covering the container body, and a suction tube inserted through the lid into the container body. The suction tube is switchable between a bent state, in which the suction tube is fixed to the lid, and an unbent state, in which the suction tube can be used by a user to suck liquid out of the container body.

Although the liquid in the container body can be prevented from flowing out when the suction tube is in the bent state, if the user forgot to bend the suction tube, once the container body is tipped over, the liquid contained in the container body will flow out through the suction tube. Thus, if a structure having an automatic spill-proof effect can be provided without requiring the operation of the user, the dilemma of accidentally knocking down the container and causing the liquid to spill may be avoided.

SUMMARY

Therefore, an object of the present disclosure is to provide a compressible device that can alleviate at least one of the drawbacks of the prior art.

Accordingly, a compressible device of this disclosure is suitable for use on a drinking container, and includes a base and at least one spill-proof unit. The base includes a base wall configured for removable connection with the drinking container and defining a liquid flow passage that extends in a top-bottom direction, and a separation wall connected to the base wall and dividing the liquid flow passage into a liquid inlet zone and a liquid outlet zone opposite to each other in the top-bottom direction. The at least one spill-proof unit includes a through slot formed in the separation wall and communicating with the liquid outlet zone, and a spill-proof seat extending downwardly from the separation wall toward the liquid inlet zone and corresponding to the through slot. The through slot has a length extending in a first horizontal direction transverse to the top-bottom direction, and a width extending in a second horizontal direction transverse to the first horizontal direction and the top-bottom direction. The spill-proof seat includes a plate body opposite to the through slot and formed with a first slit extending in the first horizontal direction. When the plate body is compressed and deformed, the first slit is opened to communicate the liquid inlet zone with the liquid outlet zone through the through slot.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
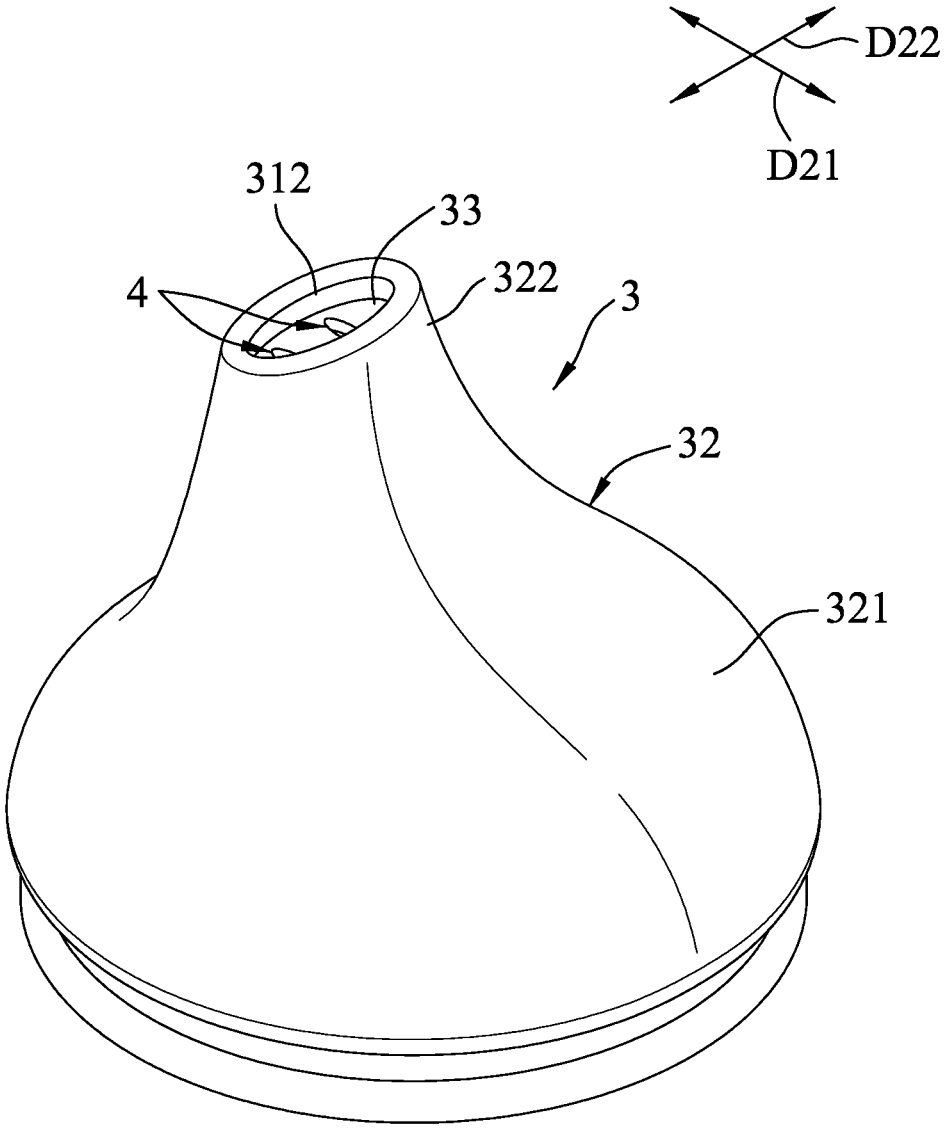
FIG. 1 is a perspective view of a compressible device according to the first embodiment of the present disclosure.

Before the present disclosure is described in greater detail with reference to the accompanying embodiments, it should be noted herein that like elements are denoted by the same reference numerals throughout the disclosure.

Figure 2:
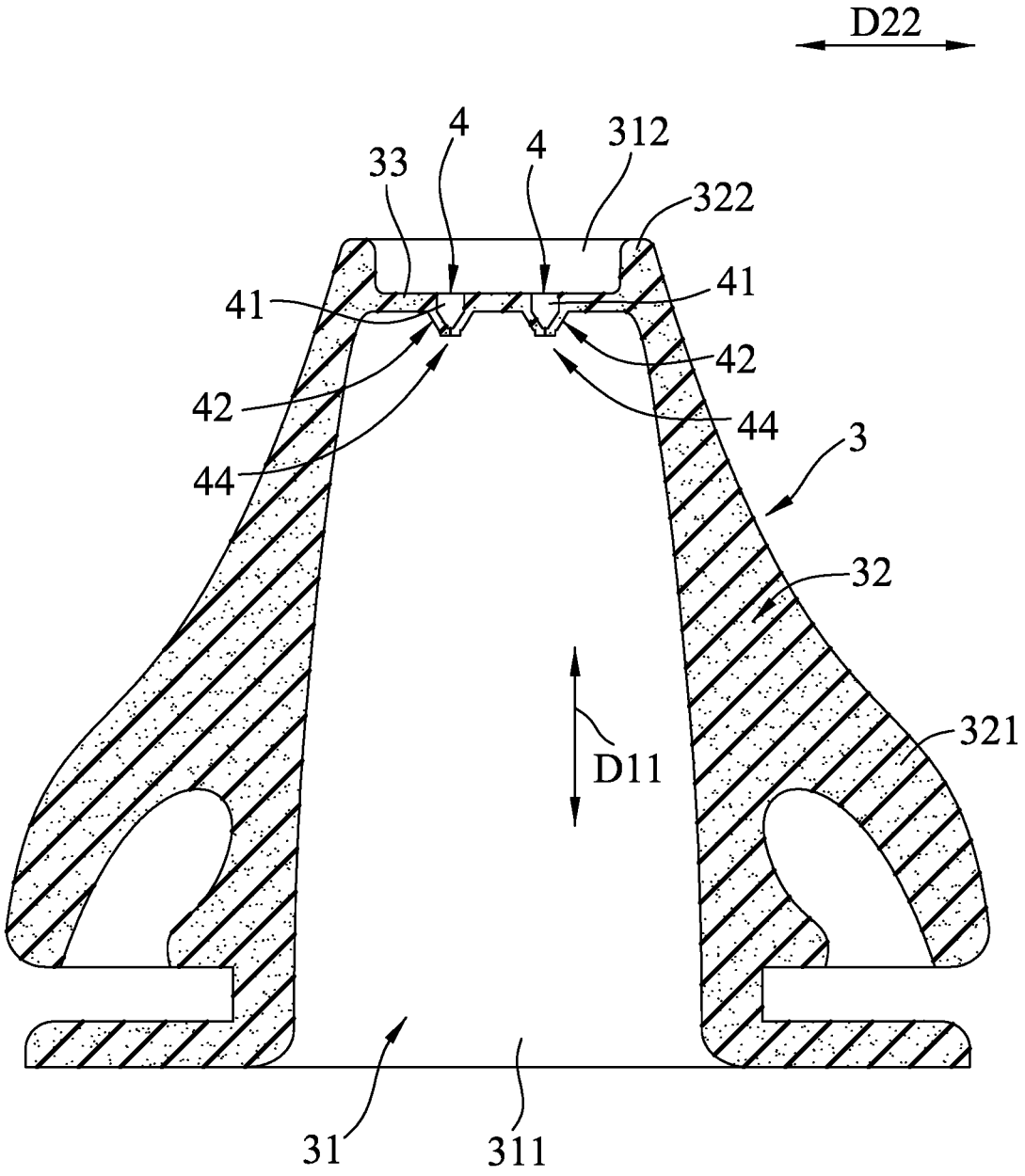
FIG. 2 is a sectional view of the first embodiment.
Figure 3:
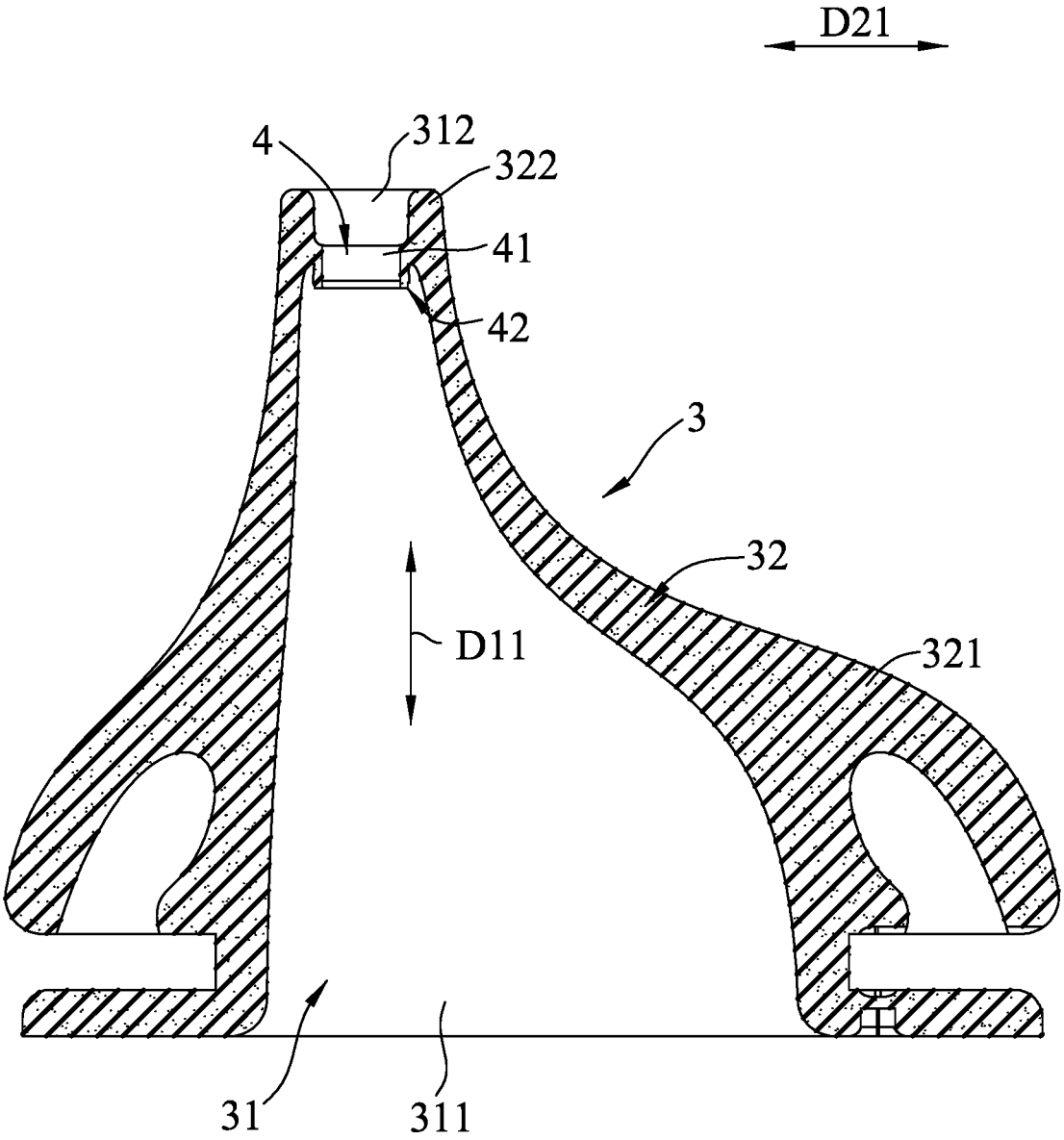
FIG. 3 is a sectional view of the first embodiment taken from another angle.

Referring to FIGS. 1 to 3, a compressible device according to the first embodiment of the present disclosure is suitable for use in cooperation with a threaded collar (not shown) of a feeding bottle (not shown), so that liquid (not shown) contained in the feeding bottle can be prevented from spilling. The liquid exemplified in this embodiment is milk for feeding a baby, but is not limited thereto. The compressible device of this embodiment includes a base 3 and a plurality of spill-proof units 4.

The base 3 has the shape of a nipple of the feeding bottle, and is made of a flexible and resilient material. The base 3 includes a base wall 32, and a separation wall 33 connected to the base wall 32.

The base wall 32 includes a bottom wall portion 321 having a water-drop shape, and a spout portion 322 extending upwardly and eccentrically from the bottom wall portion 321 and cooperating with the same to define a liquid flow passage 31. The liquid flow passage 31 extends in a top-bottom direction (D11), and tapers gradually and upwardly from the bottom wall portion 321 to the spout portion 322.

The separation wall 33 is connected between the bottom wall portion 321 and the spout portion 322, and divides the liquid flow passage 31 into a liquid inlet zone 311 and a liquid outlet zone 312 opposite to each other in the top-bottom direction (D11). The liquid inlet zone 311 is defined by the bottom wall portion 321, while the liquid outlet zone 312 is defined by the spout portion 322. The separation wall 33 has a substantially oval shape, and has a width extending in a first horizontal direction (D21) transverse to the top-bottom direction (D11), and a length extending in a second horizontal direction (D22) transverse to the first horizontal direction (D21) and the top-bottom direction (D11).

Referring to FIGS. 4 to 7, in combination with FIGS. 2 and 3, two spill-proof units 4 of the compressible device are exemplified in this embodiment. The spill-proof units 4 are integrally connected as one piece with the separation wall 33, and are spaced apart from each other in the second horizontal direction (D22). Each spill-proof unit 4 is made of a flexible and resilient material, and includes a through slot 41 formed in the separation wall 33, and a spill-proof seat 42 corresponding to the through slot 41.

The through slot 41 has a substantially oval shape, and communicates with the liquid outlet zone 312. The through slot 41 has a length extending in the first horizontal direction (D21), and a width extending in the second horizontal direction (D22).

Figure 4:
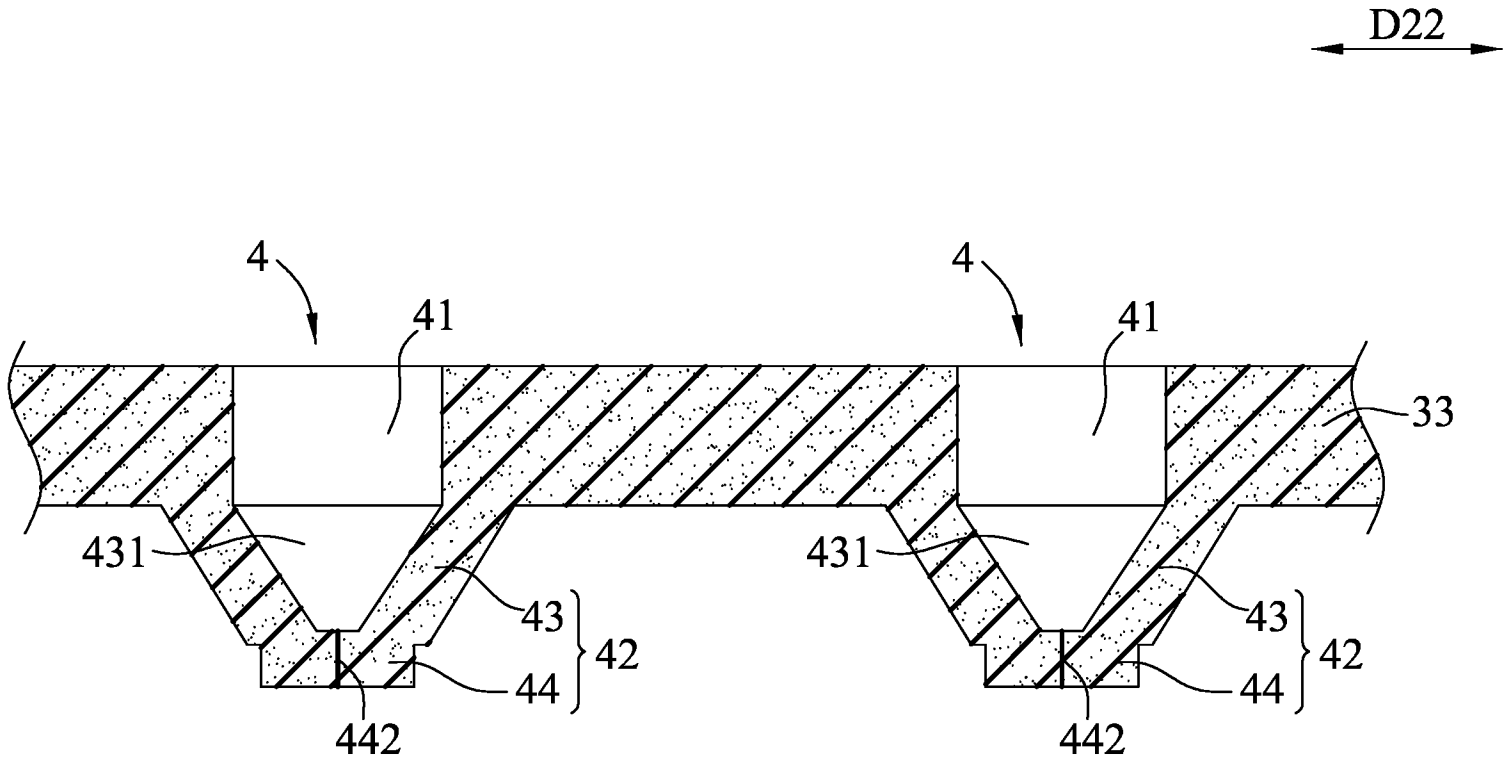
FIG. 4 is an enlarged fragmentary sectional view of the first embodiment, illustrating two spill-proof units thereof.
Figure 5:
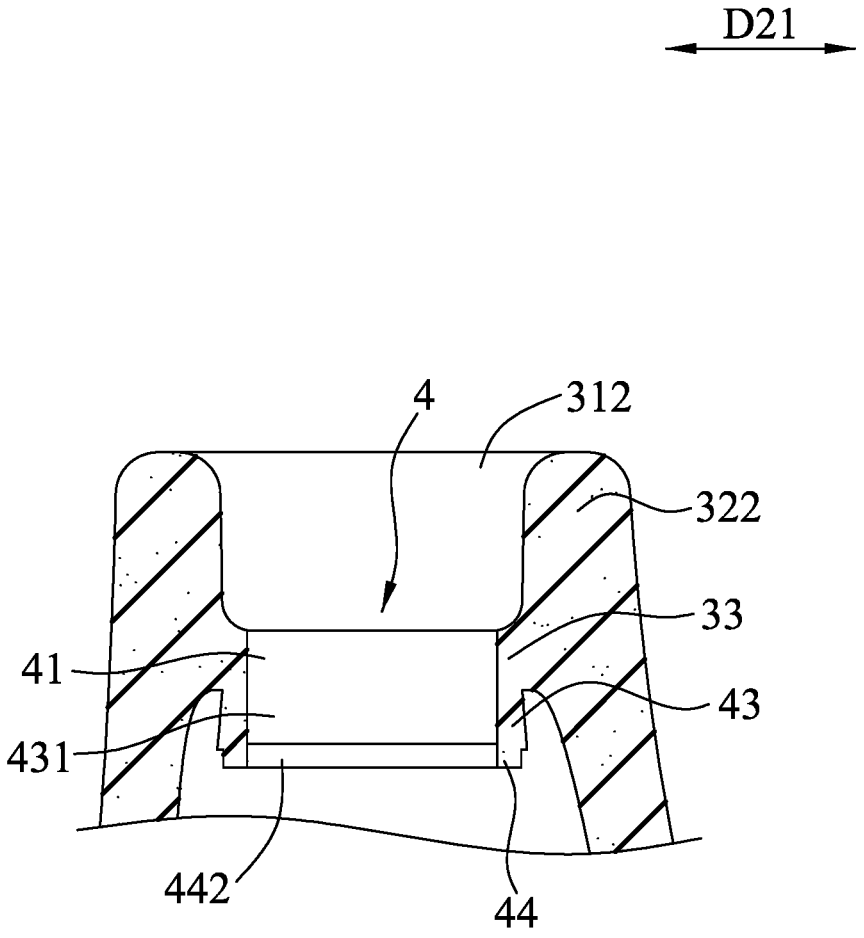
FIG. 5 is another enlarged fragmentary sectional view of the first embodiment, illustrating the spill-proof unit thereof taken from another angle.
Figure 6:
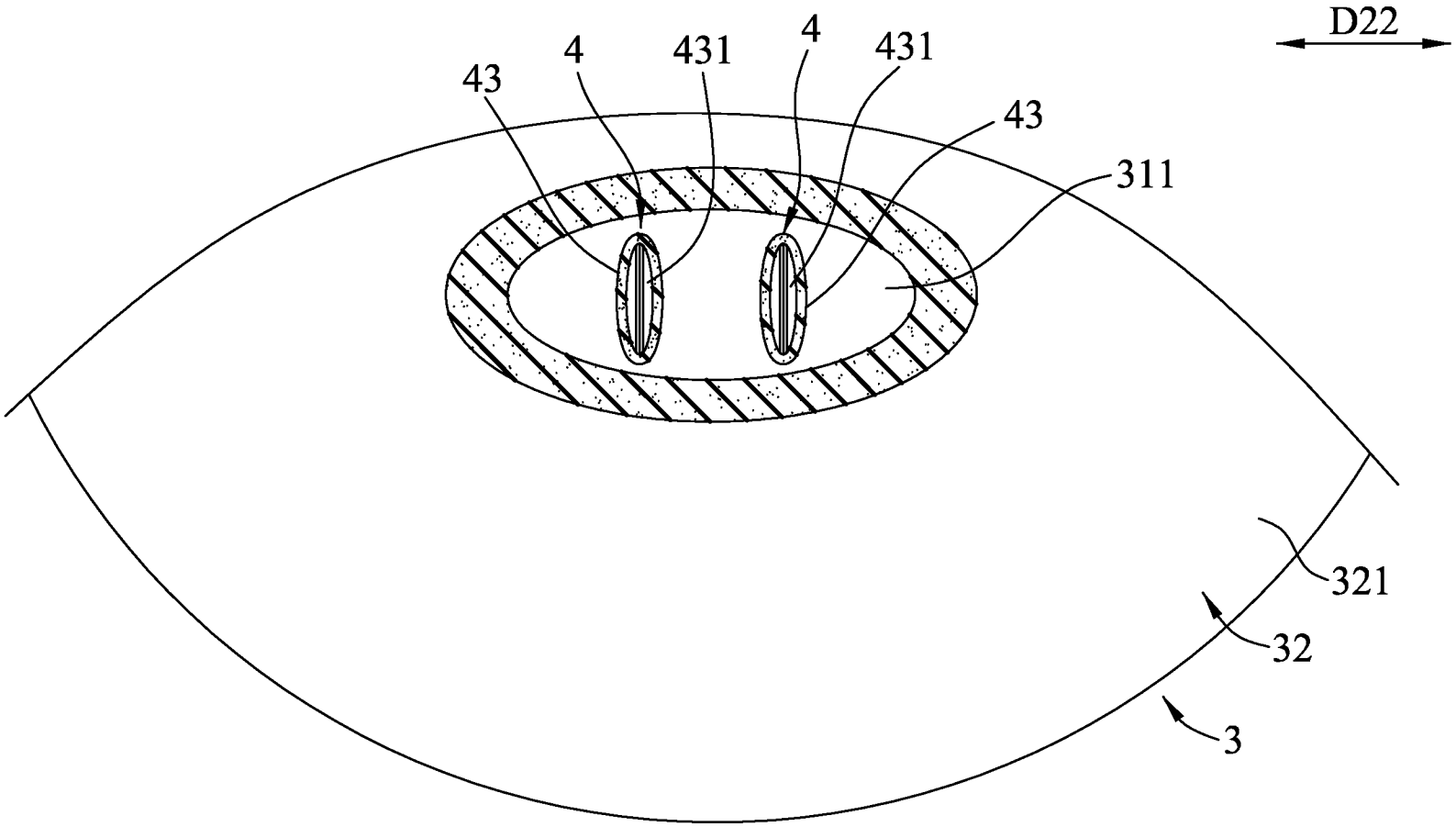
FIG. 6 is a fragmentary partial sectional top view of the first embodiment.

The spill-proof seat 42 includes a hollow body 43 extending downwardly and integrally from the separation wall 33 toward the liquid inlet zone 311, and a plate body 44 integrally connected to the bottom of the hollow body 43 and opposite to the through slot 41. In this embodiment, the hollow body 43 has a frusto-elliptical shape and a substantially oval cross section (see FIG. 6). The hollow body 43 defines a space 431 communicating with the through slot 41 and tapering inwardly and downwardly from the separation wall 33 toward the plate body 44. In other embodiment, the cross-sectional shape of the hollow body 43 may be selected from the group consisting of circular, elliptical, and rectangular. The hollow body 43 may also have a frusto-conical shape. In this embodiment, the hollow body 43 of each spill-proof seat 42, as shown in FIG. 4, tapers symmetrically, but is not limited thereto.

Figure 7:
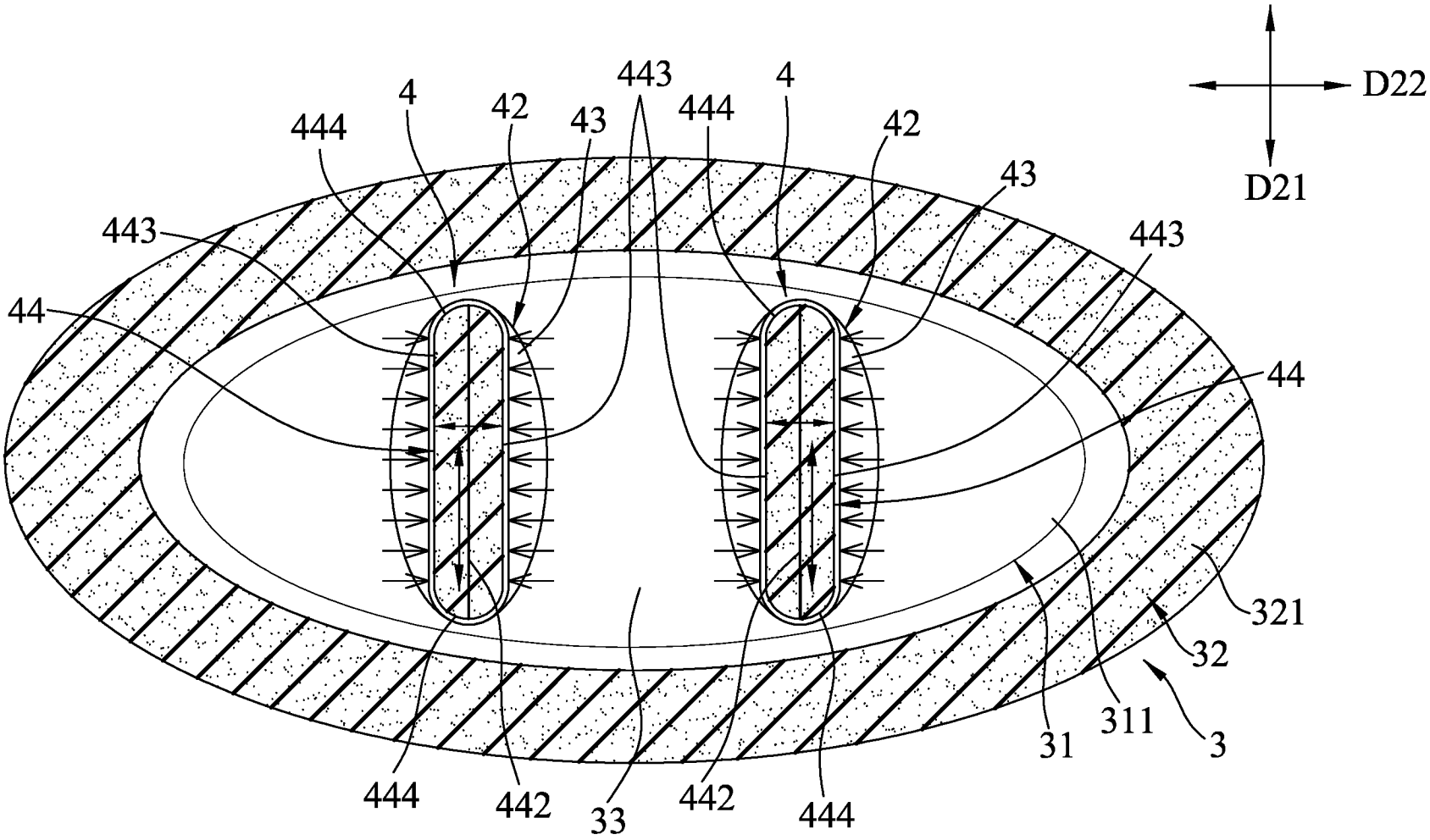
FIG. 7 is an enlarged sectional bottom view of the first embodiment.

The plate body 44 has an elongated plate shape, as best shown in FIG. 7, and has a length extending in the first horizontal direction (D21) and a width extending in the second horizontal direction (D22). The plate body 44 has two long sides 443 spaced apart from each other in the second horizontal direction (D22) and extending parallel to each other in the first horizontal direction (D21), and two short sides 444 connected between the long sides 443 and spaced apart from each other in the first horizontal direction (D21), as shown in FIG. 7. Each short side 444 has a curved shape. The plate body 44 is formed with a first slit 442 that extends between the short sides 444 and that is located between and parallel to the long sides 443. The first slit 442 of this embodiment is arranged transverse to the length of the separation wall 33.

To use the first embodiment, a user only needs to compress the spout portion 322 (see FIG. 1) between his/her lips or teeth in the first horizontal direction (D21) so as to deform the separation wall 33 and the plate body 44 also in the first horizontal direction (D21). Through this, the short sides 444 of the plate body 44 of each spill-proof unit 4 are pushed toward each other, thereby opening the first slit 442 of each spill-proof unit 4 and thereby permitting the liquid in the feeding bottle to flow from the liquid inlet zone 311 to the liquid outlet zone 312 through the first slits 442, the spaces 431 and the through slots 41 of the spill-proof units 4 and into the mouth of the user. Although the compression of the spout portion 322 in the first horizontal direction (D21) is preferred, other ways of compression may be used to discharge the liquid from the drinking container.

When the feeding bottle is tipped over, the liquid inlet zone 311 of this embodiment will be filled with the liquid. At this time, since the plate body 44 and the first slit 442 of each spill-proof unit 4 extend in the first horizontal direction (D21), the liquid pressure of the liquid (indicated by small arrows in FIG. 7) can press the plate body 44 in the second horizontal direction (D22) and force the long sides 443 thereof to move toward each other, thereby preventing the first slit 442 from being opened. An automatic spill-proof effect is thus generated.

Although two spill-proof units 4 are provided in this embodiment, in other embodiment, the number of the spill-proof unit 4 may be one, three or more. Further, the size of the spill-proof unit 4 may be modified according to the requirement, and is not limited to the disclosure of the first embodiment.

Figure 8:
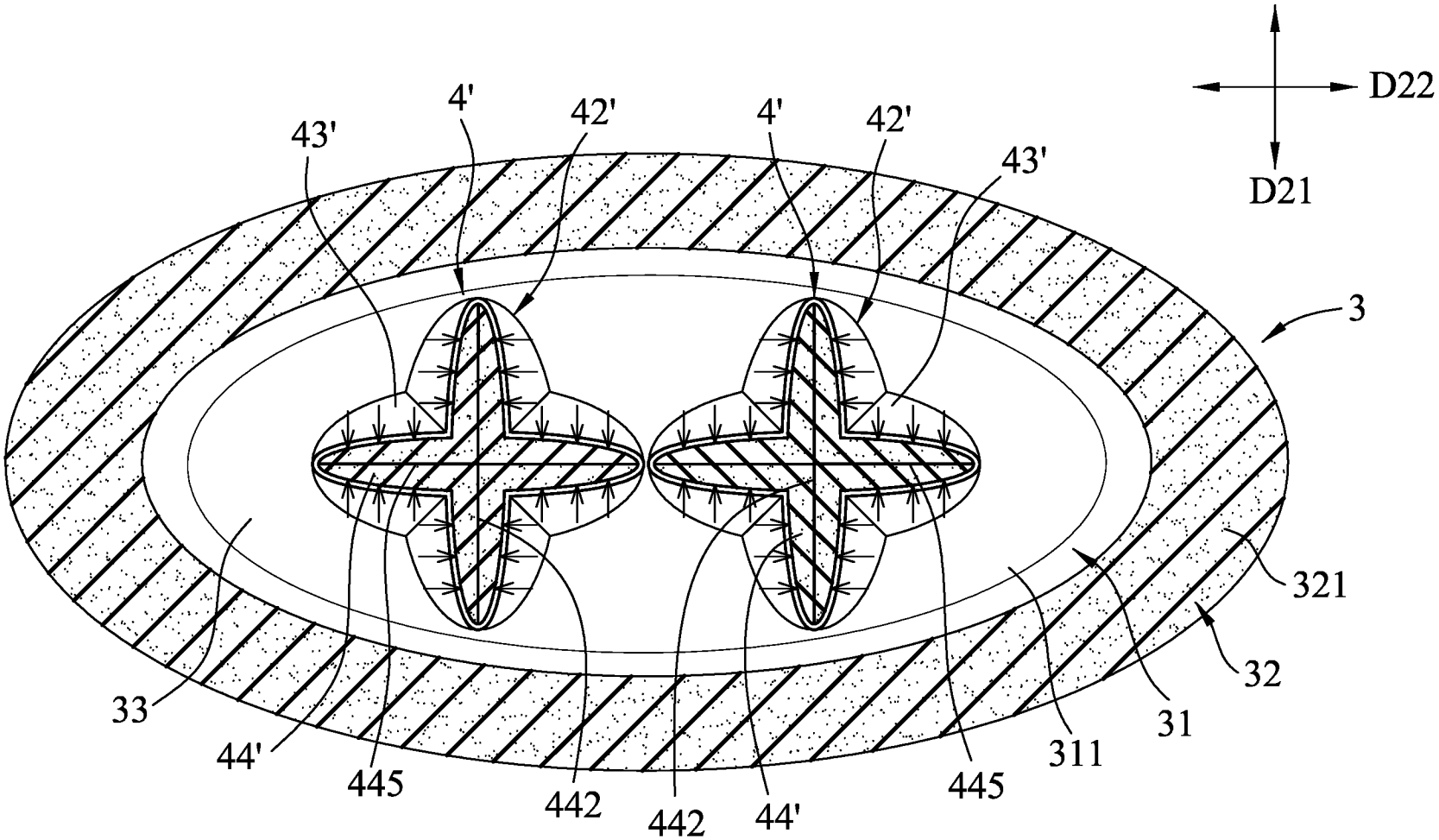
FIG. 8 is an enlarged sectional bottom view of a compressible device according to the second embodiment of this disclosure.

Referring to FIG. 8, the second embodiment of the compressible device of this disclosure is shown to be substantially the same as the first embodiment, and only differs in the structure of the spill-proof seat 42' of each spill-proof unit 4'. In this embodiment, the hollow body 43' of the spill-proof seat 42' has a four-petal shape, while the plate body 44' thereof has a substantially cross shape. The plate body 44' further has a second slit 445 extending in the second horizontal direction (D22) and intersecting the first slit 442, so that the plate body 44' has a cross-shaped slit. When the plate body 44' is compressed and deformed, the first and second slits 442, 445 thereof can be opened to communicate the liquid inlet zone 311 (see FIG. 2) with the liquid outlet zone 312 (see FIG. 2) through the spaces 431 (see FIG. 4) and the through slots 41 (see FIG. 4) of the spill-proof units 4'.

In this embodiment, since the cross section of the plate body 44' has a substantially cross shape, and the first and second slits 442, 445 form a cross-shaped slit, when the liquid inlet zone 311 is filled with liquid, it is ensured that the first and second slits 442, 445 can be prevented from being opened under the action of the liquid pressure of the liquid (indicated by small arrows in FIG. 8) on the plate body 44', thereby achieving an automatic spill-proof effect similar to that of the first embodiment.

Figure 9:
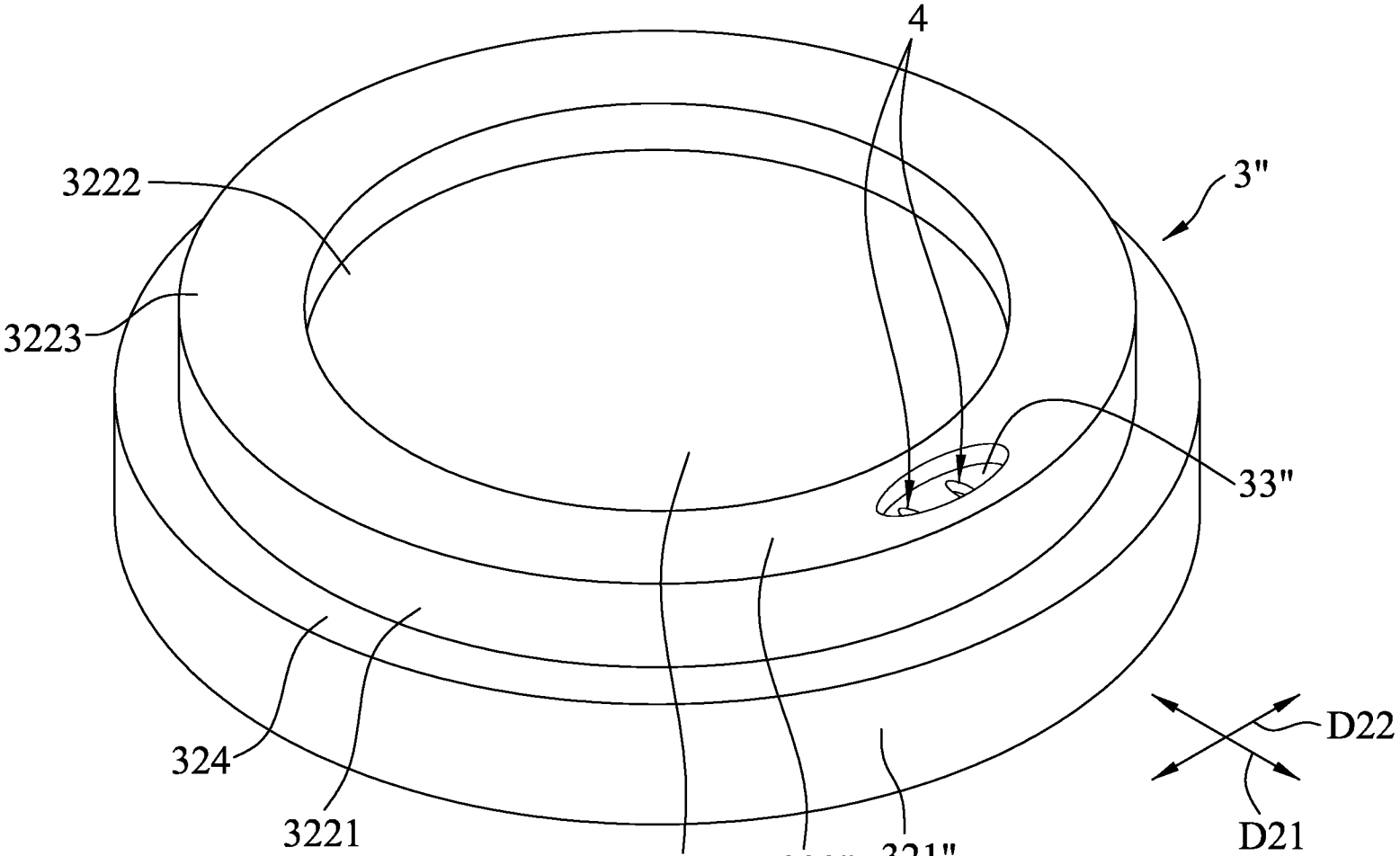
FIG. 9 is a perspective view of a compressible device according to the third embodiment of this disclosure.
Figure 10:
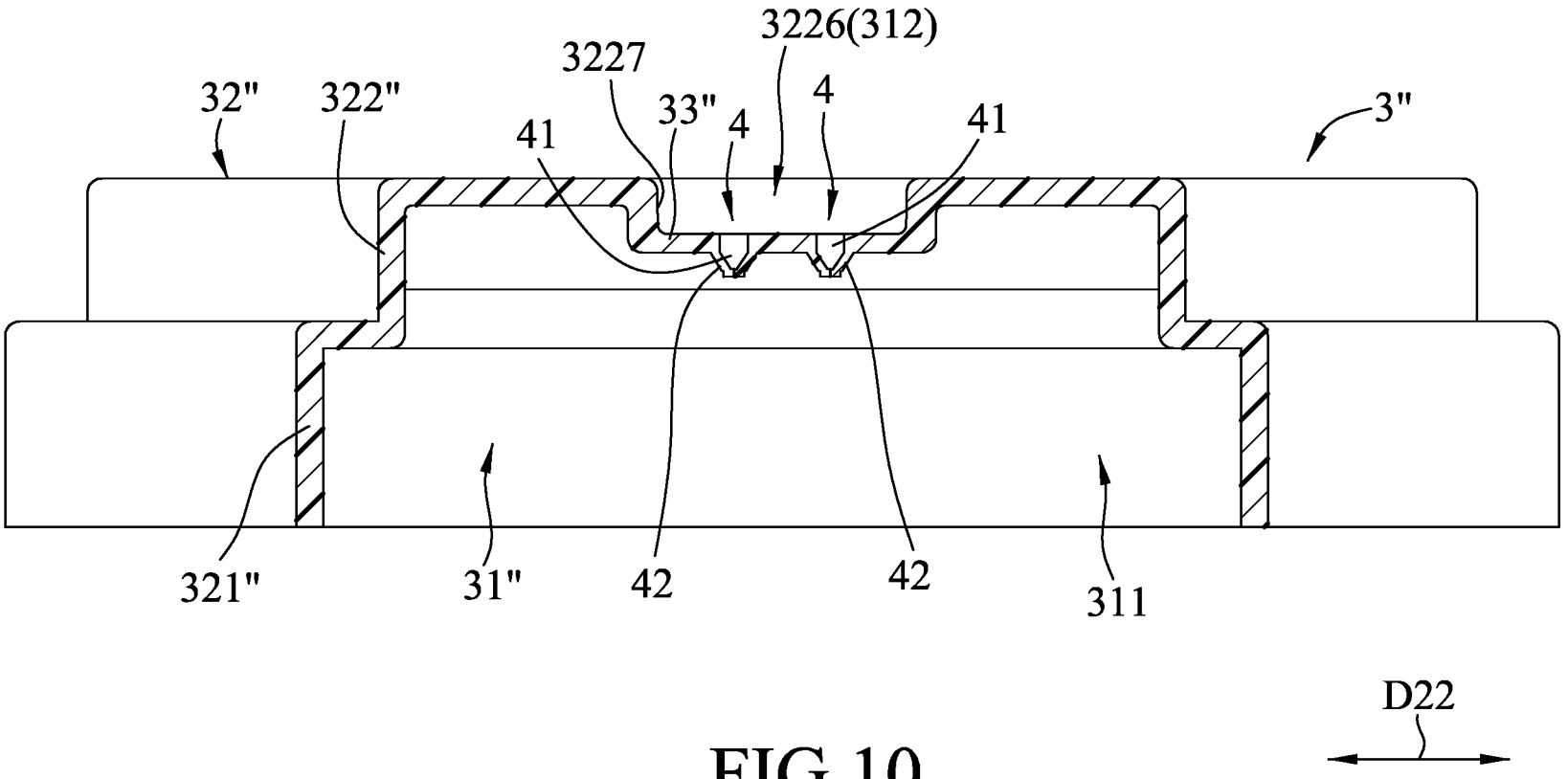
FIG. 10 is a sectional view of the third embodiment.
Figure 11:
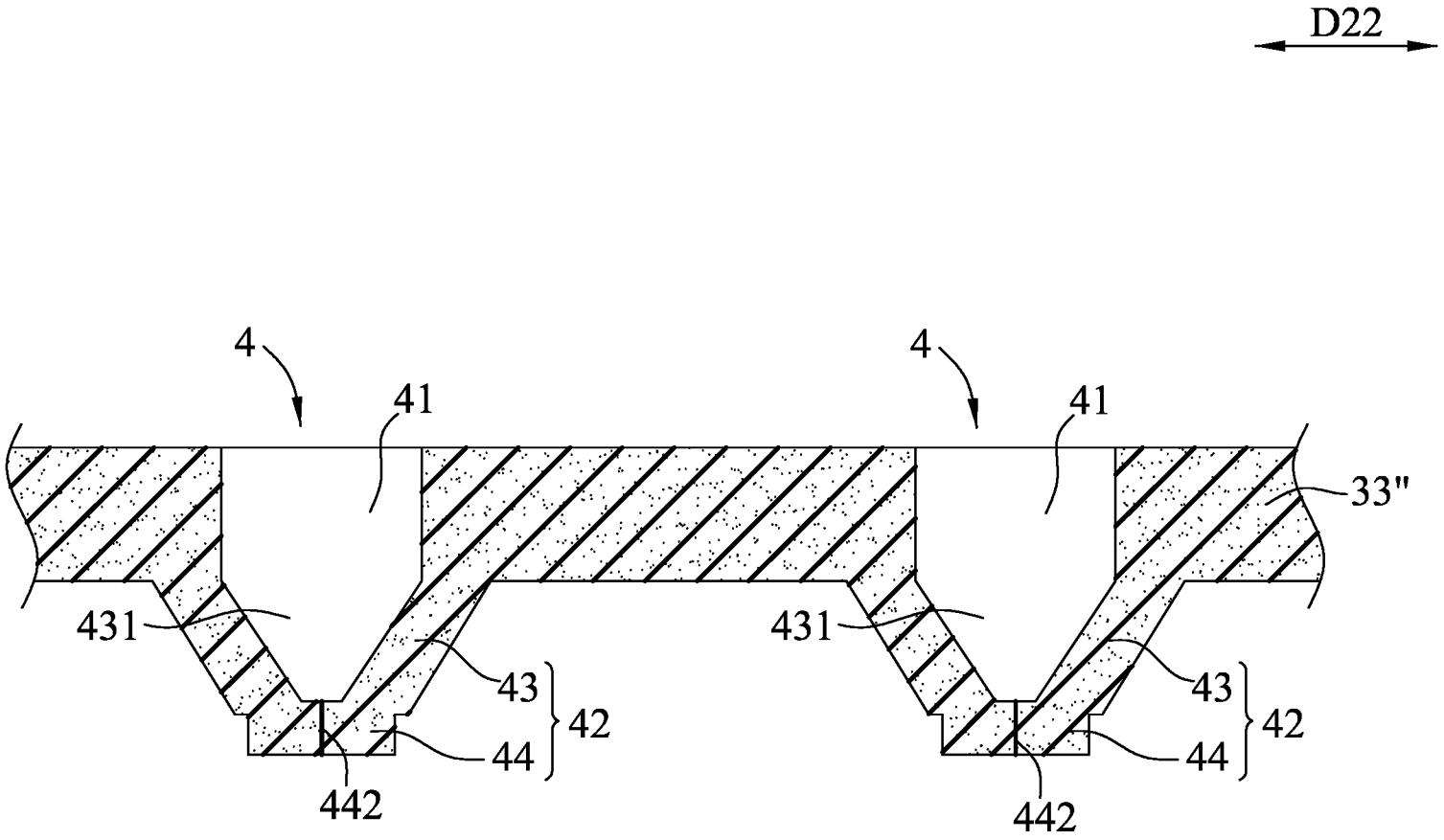
FIG. 11 is an enlarged fragmentary sectional view of the third embodiment, illustrating two spill-proof units thereof.

Referring to FIGS. 9 to 11, the third embodiment of the compressible device of this disclosure differs from the first embodiment in that the compressible device of this embodiment is suitable for use with a drinking cup, such as a coffee cup (not shown). The base wall 32" of the base 3" has the shape of a lid of the coffee cup, and includes a bottom wall portion 321" and a spout portion 322" that are both annular in shapes and that cooperate with each other to define a liquid flow passage 31" having a stepped shape. The bottom wall portion 321" is configured to be detachably connected to the rim of the coffee cup. The spout portion 322" has an outer peripheral surface 3221 connected to a top periphery of the bottom wall portion 321" through an annular flange 324, an inner peripheral surface 3222 opposite to the outer peripheral surface 3221, and a top peripheral surface 3223 connected between top peripheries of the outer and inner peripheral surfaces 3221, 3222. The base wall 32" further includes a cover wall portion 323 connected to a bottom periphery of the inner peripheral surface 3222.

The top peripheral surface 3223 of the spout portion 322" is formed with an oval-shaped hole 3226 defined by a hole-defining wall 3227. In this embodiment, the oval-shaped hole 3226 serves as the liquid outlet zone 312. The separation wall 33" is integrally connected to and extends downwardly from the hole-defining wall 3227 to separate the liquid inlet zone 311 from the oval-shaped hole 3226 or the liquid outlet zone 312.

The structure of each spill-proof unit 4 is similar to that described in the first embodiment. Particularly, each spill-proof unit 4 includes the through slot 41 formed in the separation wall 33, and the spill-proof seat 42 including the hollow body 43 extending downwardly and integrally from the separation wall 33 toward the liquid inlet zone 311, and the plate body 44 integrally connected to the bottom of the hollow body 43.

In use, the user only needs to compress the inner and outer peripheral surfaces 3222, 3221 of the spout portion 322" between his/her lips or teeth so as to move the short sides 444 (see FIG. 7) of the plate body 44 of each spill-proof unit 4 toward each other, thereby opening the first slit 442 of each spill-proof unit 4 and permitting the liquid in the drinking cup to flow from the liquid inlet zone 311 to the liquid outlet zone 312 through the first slits 442, the spaces 431" and the through slots 41" of the spill-proof units 4" and into the mouth of the user.

Hence, the third embodiment can similarly achieve the automatic spill-proof effect of the first embodiment.

Figure 12:
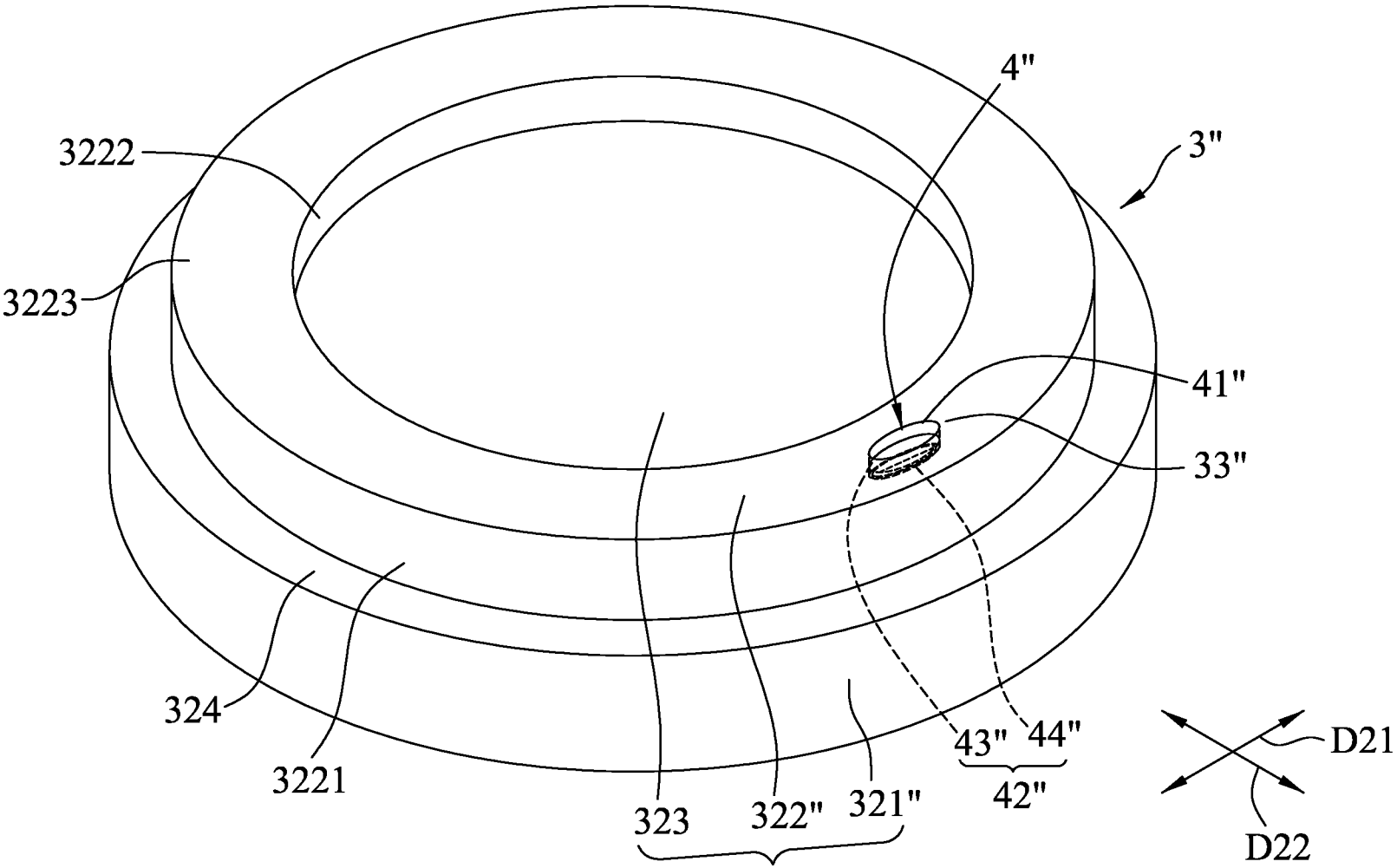
FIG. 12 is a perspective view of a compressible device according to the fourth embodiment of this disclosure.
Figure 13:
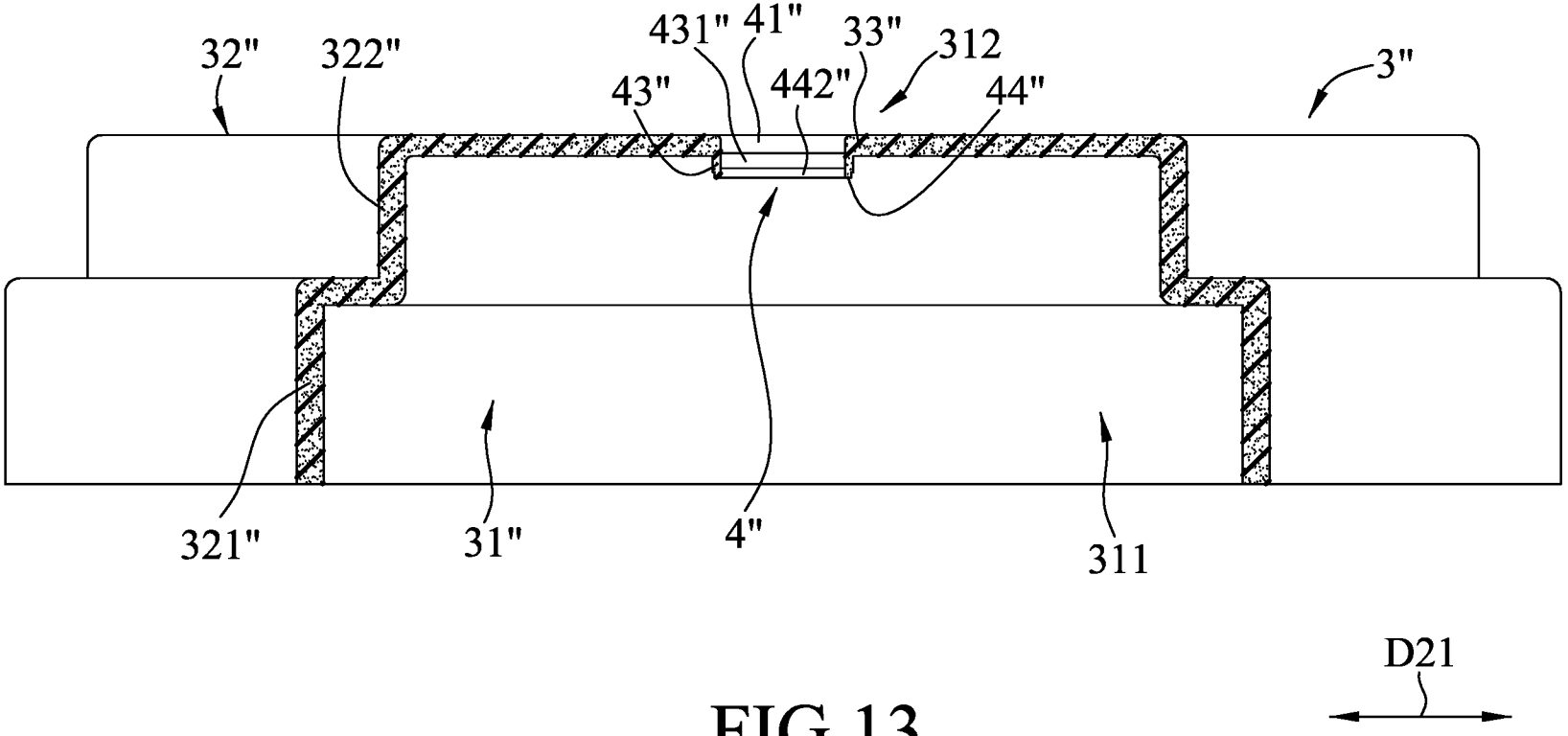
FIG. 13 is a sectional view of the fourth embodiment.
Figure 14:
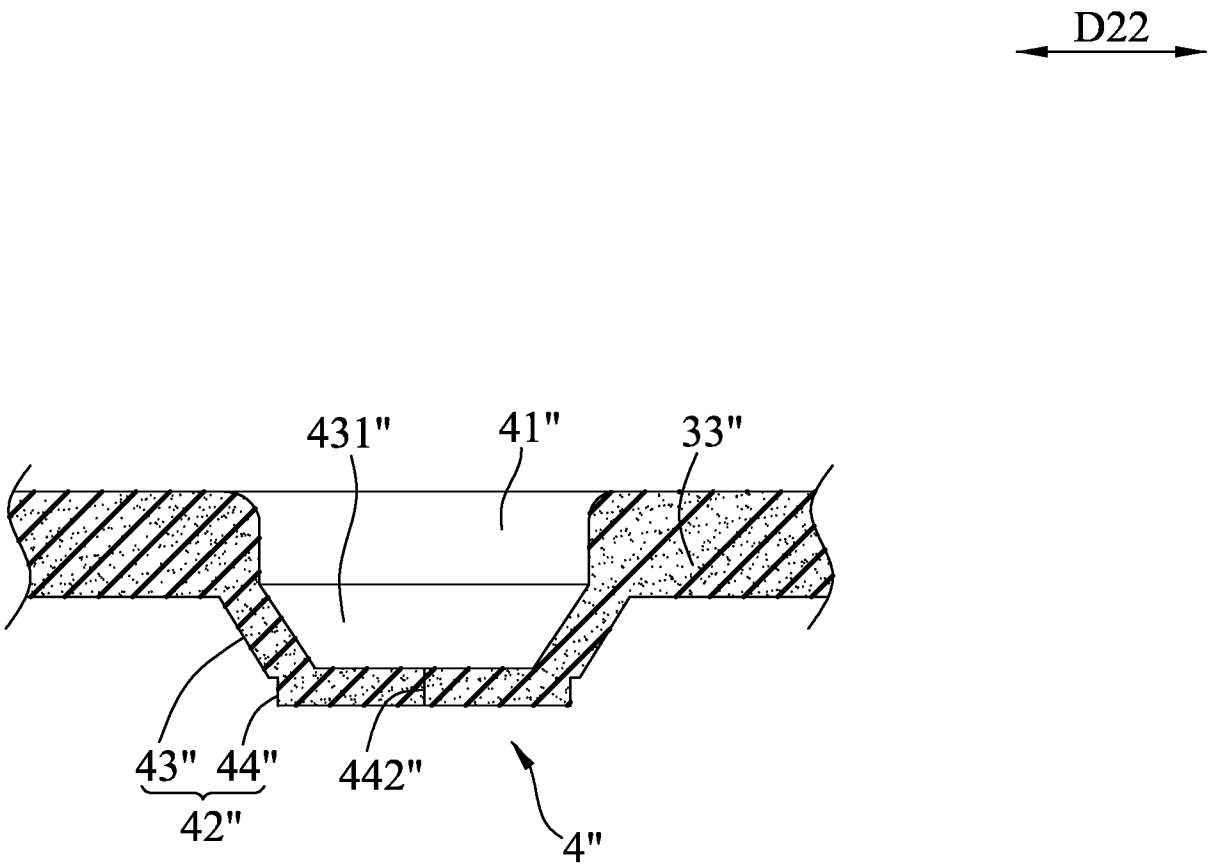
FIG. 14 is an enlarged fragmentary sectional view of the fourth embodiment, illustrating a spill-proof unit thereof.

Referring to FIGS. 12 to 14, the fourth embodiment of the compressible device of this disclosure is shown to be substantially similar to the third embodiment, and differs in that the compressible device of this embodiment includes only one spill-proof unit 4". Further, the separation wall 33" is integrally formed as one piece with the top peripheral surface 3223 of the spout portion 322", and the through slot 41" of the spill-proof unit 4" is formed in the top peripheral surface 3223. The through hole 41" communicates with the external environment which serves as the liquid outlet zone 312 in this embodiment. The hollow body 43" of the spill-proof seat 42" extends downwardly and integrally from the top peripheral surface 3223 toward the liquid inlet zone 311 at a position corresponding to the through slot 41".

The fourth embodiment can similarly achieve the automatic spill-proof effect of the third embodiment.

In other embodiments of this disclosure, apart from having the shape of the coffee cup lid or nipple of the feeding bottle, the base 3 may also have the shape of a suction tube.

In sum, the effect of the compressible device of this disclosure resides in: through the structural designs of the plate body 44 and the first slit 442 (and the second slit 445), even if the user does not take special spill-proof measures, the plate body 44 can be automatically compressed by the liquid pressure of the liquid to ensure that the first slit 442 (and the second slit 445) will not open, thereby generating an automatic spill-proof effect.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the present disclosure has been described in connection with what are considered the most practical embodiment, it is understood that this disclosure is not limited to the disclosed embodiments but is intended to cover various arrangements included within the spirit and scope of the broadest interpretation so as to encompass all such modifications and equivalent arrangements.

What is claimed is:

1. A compressible device suitable for use on a drinking container, comprising:

a base including a base wall configured for removable connection with the drinking container and defining a liquid flow passage that extends in a top-bottom direction, and a separation wall connected to said base wall and dividing said liquid flow passage into a liquid inlet zone and a liquid outlet zone opposite to each other in the top-bottom direction; and at least one spill-proof unit including a through slot formed in said separation wall and communicating with said liquid outlet zone, and a spill-proof seat extending downwardly from said separation wall toward said liquid inlet zone and corresponding to said through slot, said through slot having a length extending in a first horizontal direction transverse to the top-bottom direction, and a width extending in a second horizontal direction transverse to the first horizontal direction and the top-bottom direction, said spill-proof seat including a plate body opposite to said through slot and formed with a first slit extending in the first horizontal direction, and a hollow body connected between said separation wall and said plate body and defining a space communicating with said through slot;

wherein said plate body has an elongated plate shape, and has two long sides extending in the first horizontal direction and spaced apart from each other in the second horizontal direction, and two short sides connected between said long sides and spaced apart from each other in the first horizontal direction;

wherein said first slit is located between and is parallel to said long sides; and wherein, when said plate body is compressed and deformed, said first slit is opened to communicate said liquid inlet zone with said liquid outlet zone through said through slot.

2. The compressible device as claimed in claim 1, wherein said space defined by said hollow body tapers inwardly and downwardly from said separation wall toward said plate body.

3. The compressible device as claimed in claim 2, wherein the cross-sectional shape of said hollow body is selected from the group consisting of oval, circular, elliptical, and rectangular.

4. The compressible device as claimed in claim 1, wherein each of said short sides has a curved shape.

5. The compressible device as claimed in claim 1, wherein said plate body has a substantially cross shape, and is further formed with a second slit extending in the second horizontal direction and intersecting said first slit.

6. The compressible device as claimed in claim 1, wherein said compressible device comprises a plurality of said spill-proof units spaced apart from one another in the second horizontal direction.

* * * * *